US011655834B2

(12) United States Patent
Hoffmann et al.

(10) Patent No.: US 11,655,834 B2
(45) Date of Patent: May 23, 2023

(54) HYDROSTATIC DRIVE

(71) Applicant: Robert Bosch GmbH, Stuttgart (DE)

(72) Inventors: Dominik Thomas Hoffmann, Ulm (DE); Uwe Vetter, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/322,126

(22) Filed: May 17, 2021

(65) Prior Publication Data

US 2021/0355973 A1 Nov. 18, 2021

(30) Foreign Application Priority Data

May 18, 2020 (DE) ..... 10 2020 206 197.1

(51) Int. Cl.

| | |
|---|---|
| ***F15B 21/14*** | (2006.01) |
| ***E02F 9/22*** | (2006.01) |
| ***F15B 21/045*** | (2019.01) |
| ***F15B 15/22*** | (2006.01) |

(52) U.S. Cl.

CPC ..... *F15B 21/14* (2013.01); *E02F 9/2217* (2013.01); *F15B 15/22* (2013.01); *F15B 21/045* (2013.01); *F15B 2211/20515* (2013.01); *F15B 2211/6306* (2013.01); *F15B 2211/6343* (2013.01); *F15B 2211/761* (2013.01)

(58) Field of Classification Search

CPC ..... F15B 1/024; F15B 21/045; F15B 21/14; F15B 2211/6343; F15B 2211/761; E02F 9/2217; B60K 6/12

See application file for complete search history.

(56) References Cited

U.S. PATENT DOCUMENTS

| | | | | |
|---|---|---|---|---|
| 7,296,407 | B2 * | 11/2007 | Rose | F15B 21/0423 60/456 |
| 7,712,309 | B2 * | 5/2010 | Vigholm | E02F 9/2217 60/419 |
| 8,606,448 | B2 * | 12/2013 | Anders | B60K 6/12 903/903 |
| 8,909,434 | B2 * | 12/2014 | Anders | E02F 9/2095 701/50 |
| 8,997,476 | B2 * | 4/2015 | Brinkman | F15B 21/14 60/456 |
| 9,279,236 | B2 * | 3/2016 | Zhang | E02F 9/2292 |
| 10,174,770 | B2 * | 1/2019 | Zhang | F15B 13/021 |
| 10,280,593 | B2 * | 5/2019 | Hijikata | F15B 13/06 |
| 10,927,854 | B2 * | 2/2021 | Olesen | B66F 9/22 |
| 10,975,890 | B2 * | 4/2021 | Henderson | F15B 1/024 |
| 11,149,753 | B2 * | 10/2021 | Takahashi | F15B 19/005 |
| 11,408,445 | B2 * | 8/2022 | Wang | F15B 11/17 |
| 2022/0307524 | A1 * | 9/2022 | Wang | F15B 21/082 |

* cited by examiner

*Primary Examiner* — Michael Leslie

(74) *Attorney, Agent, or Firm* — Maginot, Moore & Beck LLP

(57) ABSTRACT

A hydrostatic drive includes at least one hydrostatic pump configured to supply at least one hydrostatic consumer and an apparatus for an energy recovery procedure of at least a part of the energy that is output by the consumer. An electronic control unit or at least one software component is further included, with which the energy recovery procedure is controlled in a variable manner and depends upon detected influencing variables.

5 Claims, 4 Drawing Sheets

HYDROSTATIC DRIVE

This application claims priority under 35 U.S.C. § 119 to patent application no. DE 10 2020 206 197.1, filed on May 18, 2020 in Germany, the disclosure of which is incorporated herein by reference in its entirety.

The disclosure relates to a hydrostatic drive as described herein.

BACKGROUND

Hydrostatic drives serve to drive at least one hydrostatic consumer. Such hydrostatic drives can be installed on mobile work machines, wherein at least one of the hydrostatic consumers can be a traction motor and further hydrostatic consumers are provided for example for the work equipment of the mobile work machine.

In accordance with the prior art, hydrostatic drives can be capable of recovering energy by means of the drive train while the consumer is braked or decelerated or while the work equipment is lowered. The energy recovery procedure is reactive or rather predetermined in this case and cannot be adapted and consequently also not be optimized. Influencing variables are generally (averaged) taken into consideration in the design of the energy recovery procedure but said influencing variables do vary in everyday operation. The resulting relevant parameters for the energy recovery procedure can no longer be changed during operation.

SUMMARY

It follows from this that the object of the disclosure is to create a hydrostatic drive wherein the energy recovery procedure is optimized.

This object is achieved by means of a hydrostatic drive as disclosed herein.

The claimed hydrostatic drive has at least one hydrostatic pump and at least one hydrostatic consumer that can be supplied by way of the pump. Furthermore, an apparatus is provided for the energy recovery procedure of at least a part of the braking energy or decelerating energy or potential energy of the consumer. In accordance with the disclosure, the apparatus has a software component or an electronic control unit, both of which are designed so as to control the energy recovery procedure in a variable manner and in dependence upon at least one detected influencing variable.

Relevant influencing variables are detected for example by way of a temperature sensor, a pressure sensor, a pivot angle sensor, a position sensor and/or an acceleration sensor for components of the hydrostatic drive.

The influencing variables are evaluated in order to optimize the energy recovery procedure itself or to optimize the switching procedures between the motor mode operation and the generator mode operation.

The strategy of the energy recovery procedure is adapted based on the respective influencing variable and consequently the energy recovery procedure can be optimized in particular with respect to energy efficiency but also with respect to the comfort of the operator, the time required when switching over at the beginning or at the end of the energy recovery procedure, the dynamics of the power output after terminating the energy recovery procedure, the capacity and durability of components and also the serviceable life of the hydrostatic drive.

The greater the number of influencing variables detected and taken into consideration, the better the optimizing goal can be realized or a plurality of said optimizing goals can be realized.

The energy recovery procedure by means of the electronic control unit is particularly advantageous with respect to the above mentioned approaches with regard to optimization if the procedure is autodidactic.

In the case of a particularly efficient development where applicable by means of an efficient learning algorithm, the energy recovery procedure can be controlled in a predicative manner by means of the electronic control unit.

In this case, influencing variables such as the temperature of the operating means and/or the pressure of the operating means which can be detected in a simple manner with regard to the apparatus by way of the corresponding sensors that have already been mentioned above are taken into consideration.

The hydrostatic drive in accordance with the disclosure can be embodied as a power unit, wherein the consumer or one of the consumers is a traction motor that can function as a pump during the braking operation. Such power units can be installed in a mobile work machine. In this case, a large amount of braking and decelerating energy is often available, the effective energy recovery is therefore of great importance.

Relevant influencing variables are detected for example by way of a positioning system (for example GPS), and/or an acceleration sensor for the relevant mobile work machine.

The driving behavior of the driver and/or the selected travel mode can also serve as influencing variables that are taken into consideration in accordance with the disclosure.

The consumer or one of the consumers can form work equipment of the mobile work machine, wherein the recovered braking energy is generated from mass inertia (for example when a rotary drive of an upper structure of a digger is braked) or from potential energy (for example when a boom of a digger or a shovel of an earth mover is lowered).

The work task and/or the position of the consumer or of the work equipment can be taken into consideration (by means of position sensors and/or acceleration sensors) as a relevant influencing variable.

The material that is to be processed or handled (for example by means of a camera) can be taken into consideration as a relevant influencing variable.

The selected operating mode and/or behavior of the operator can be taken into consideration as a relevant influencing variable. It is possible to use for this purpose a position sensor and/or an acceleration sensor on a joystick, accelerator pedal, brake pedal and/or inch pedal.

Environmental influences such as for example ambient temperature (by means of a temperature sensor) and/or the surrounding topology (for example by means of a camera, radar, lidar and/or digital map material in conjunction with a positioning system (for example GPS) can be taken into consideration as influencing variables that are relevant in accordance with the disclosure.

The braking energy or decelerating energy results from for example the mass inertia of the travelling mobile work machine (or the traction motor that is acting as a pump) or from the mass inertia of the rotating upper structure (by way of the digger's rotary motor that is acting as a pump) or from the potential energy of a loaded shovel (for example by way of a lifting cylinder of the digger or earthmover).

In accordance with a first principal, the energy recovery procedure is a recuperation procedure.

In this case, it is particularly simple with regard to the apparatus if the braking energy or decelerating energy can be stored in a hydraulic accumulator.

The pump of the hydrostatic drive in accordance with the disclosure is preferably configured so as to be driven by a primary drive that is embodied as an internal combustion engine or electric motor.

In the case of the electric motor, the braking energy can be converted into electric energy by the pump that is operated as a motor and the electric motor that is operated as a generator and stored in an electric storage device.

In the case of the internal combustion engine, said combustion engine can be set to the optimal operating point for the following power output prior to the energy recovery procedure being terminated or at least prior to the subsequent restriction operation being terminated. It is possible in this case for example to increase the rotational speed.

In accordance with a second principle, the energy recovery procedure is a regeneration procedure. In this case, another consumer of the hydrostatic drive is directly supplied with the recovered braking energy or decelerating energy.

An exemplary embodiment of a hydrostatic drive in accordance with the disclosure having different strategies for the energy recovery procedure is illustrated in the figures.

BRIEF DESCRIPTION

DETAILED DESCRIPTION

Figure 1:
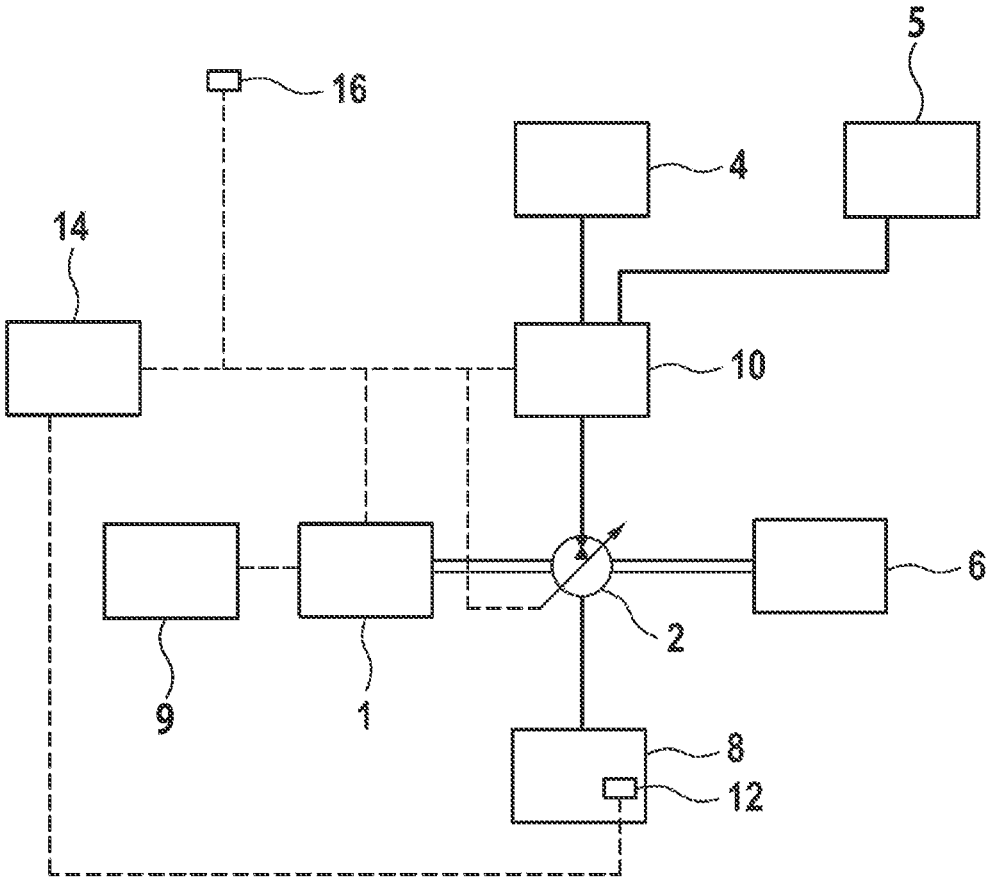
FIG. 1 illustrates an exemplary embodiment of the hydrostatic drive in accordance with the disclosure.

FIG. 1 illustrates an exemplary embodiment of the hydrostatic drive in accordance with the invention that is installed in a mobile work machine (not further illustrated). A hydrostatic pump 2, which has an adjustable or non-adjustable flow volume, for supplying a first consumer 4 and a second consumer 5, and one or more further pumps 6 for other work functions or for auxiliary units are driven by a primary drive 1 that can be a diesel engine or an electric motor. In embodiments having the primary drive 1 configured as an electric motor, the hydrostatic drive further includes an electronic storage device 9. The electronic storage device 9 is operably connected to the primary drive 1.

The pump 2 draws in oil from a tank 8 and conveys it to the consumer 4 by way of a valve block 10 having a restrictor. A temperature sensor 12 is arranged in the tank 8.

An electronic control unit 14 is connected by means of signal lines to the primary drive 1, the pump 2, the valve block 10, the temperature sensor 12 and a sensor arrangement 16. The sensor arrangement 16 comprises in the illustrated exemplary embodiment a position sensor and an apparatus for detecting the surrounding topology (for example a camera). Furthermore, the sensor arrangement 16 can also comprise an acceleration sensor or one of the other sensors mentioned in this document. In particular, the sensor arrangement 16 comprises in the case of the illustrated exemplary embodiment a plurality of pressure sensors that are naturally arranged on components that are influenced by pressure, such as the pump 2, the valve block 10, the consumer 4, the tank 8 or on lines that are arranged between them.

Figure 2:
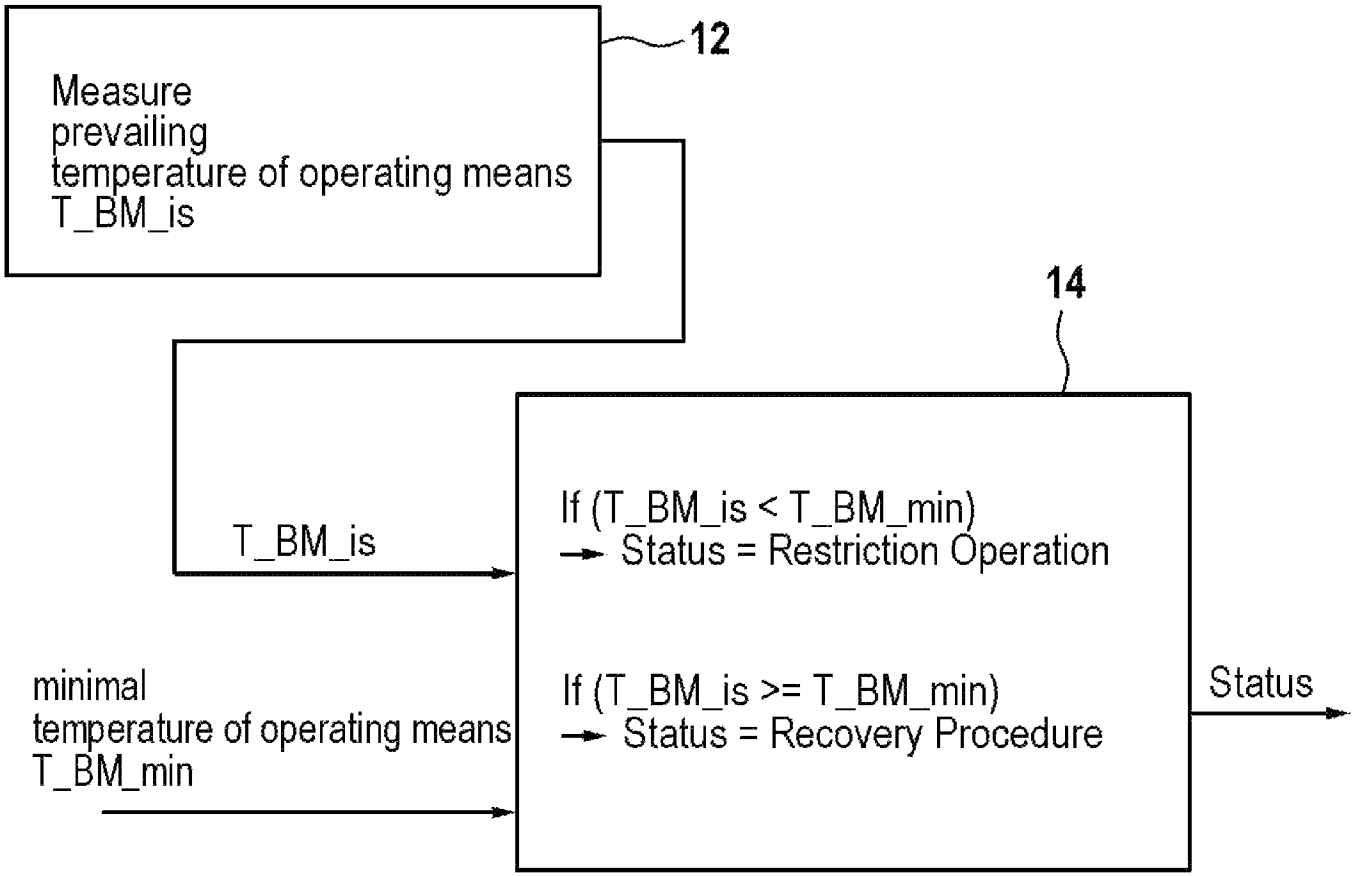
FIG. 2 illustrates a first strategy for the energy recovery procedure using the hydrostatic drive shown in FIG. 1.

FIG. 2 illustrates a first strategy for the energy recovery procedure using the hydrostatic drive shown in FIG. 1. This strategy takes into consideration the influencing variable 'temperature of the operating means' which is detected by means of the temperature sensor 12 in the tank 8. In the case of this strategy, the energy recovery procedure is switched off until the oil is brought to an optimal operating temperature by means of a restriction operation by way of the valve block 10. The cold start behavior of the hydrostatic drive is optimized as a result. The status represents in this case whether an energy recovery procedure is requested or whether on the other hand a restriction operation is performed.

Figure 3:
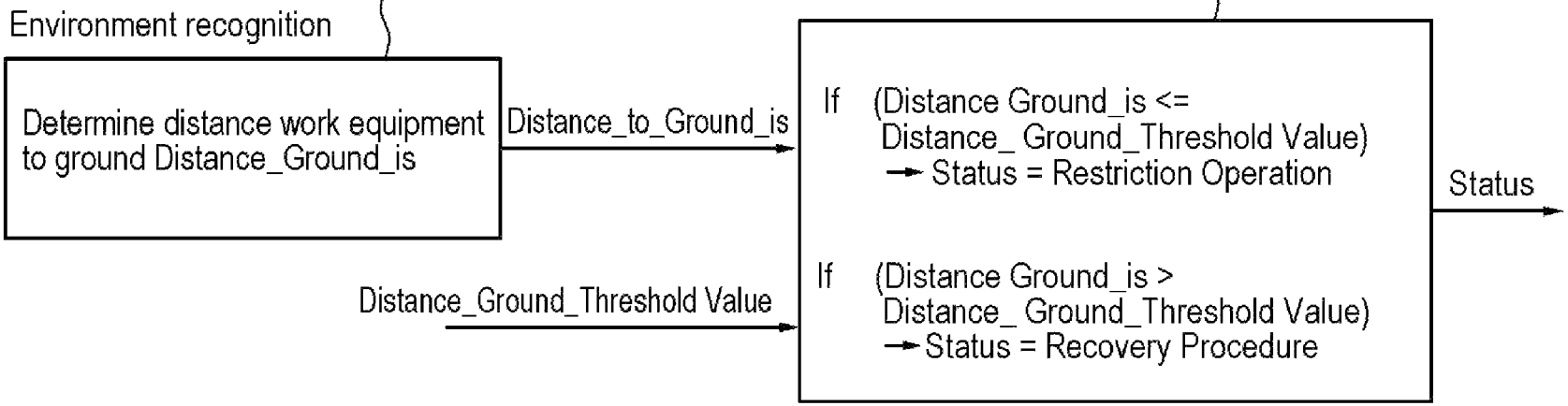
FIG. 3 illustrates a second strategy for the energy recovery procedure using the hydrostatic drive shown in FIG. 1.

FIG. 3 illustrates a second strategy for the energy recovery procedure based on the hydrostatic drive shown in FIG. 1. The influencing variables 'ambient topology' and 'position' are taken into consideration. For this purpose, the sensor arrangement 16 has a position sensor and an apparatus for detecting the surrounding topology (for example a camera). The work equipment is lowered and in this case potential energy recovered. The point in time in which the work equipment strikes the ground is predicted prior to the work equipment striking the ground, in other words in advance. The energy recovery procedure can consequently be terminated shortly before said work equipment strikes the ground.

It is consequently possible to initiate in advance necessary switching procedures in the drive train which can involve a very long period of time. As a consequence, a uniform operating behavior is realized. Switching pressures, pressure peaks or interruptions in the traction force are reduced. The mentioned switching procedure can be a full pivot movement or a change in the rotational direction of the pump 2.

Figure 4:
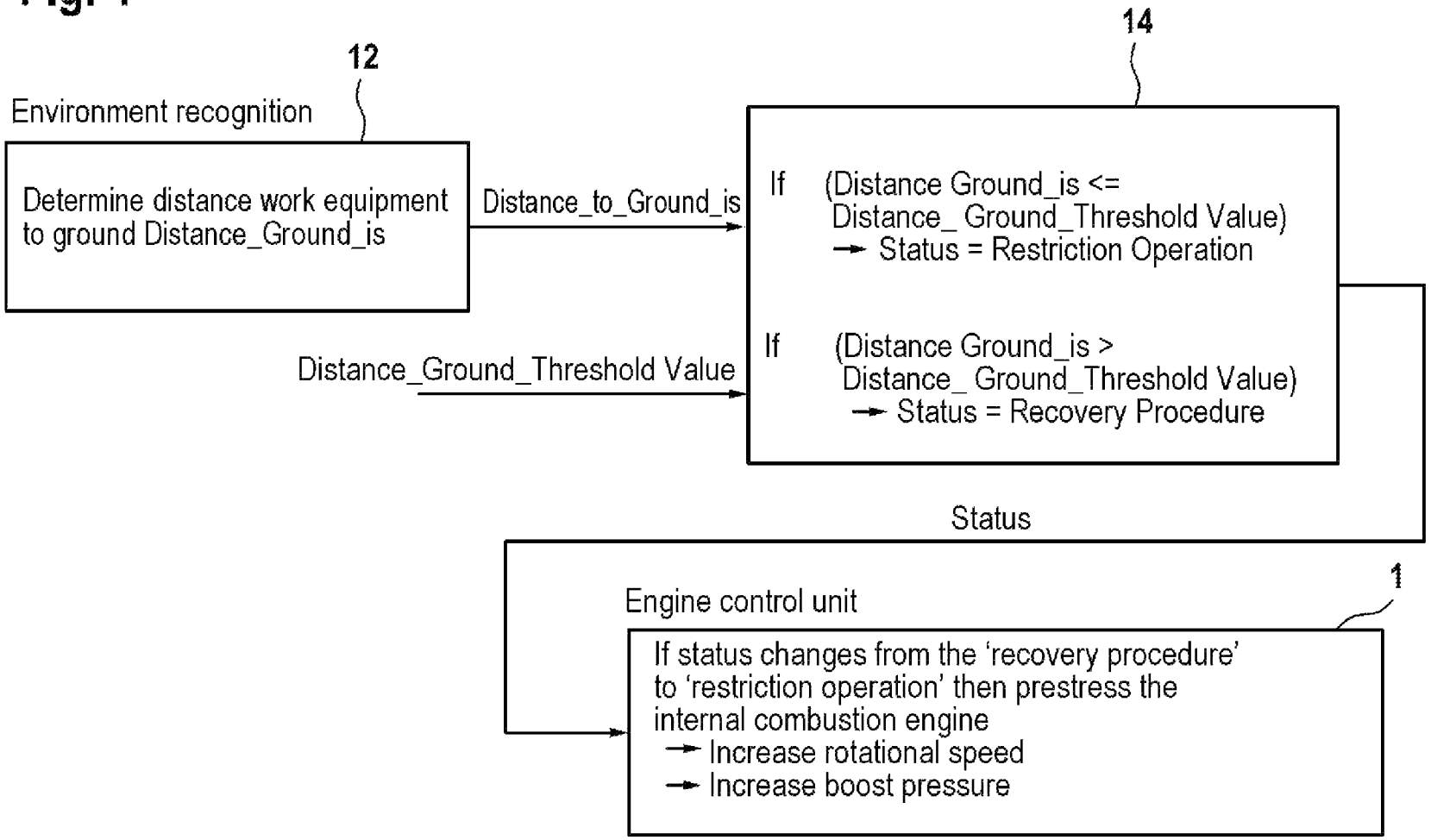
FIG. 4 illustrates a third strategy for the energy recovery procedure using the hydrostatic drive shown in FIG. 1.

FIG. 4 illustrates a third strategy for the energy recovery procedure using the hydrostatic drive shown in FIG. 1. The influencing variables 'surrounding topology' and 'position' are also taken into consideration in this case. As in the case of the second strategy, the end time point for the energy recovery procedure is predicted, in other words is calculated in advance. Consequently, it is necessary for the drive train to change from the generator mode into the motor mode and output power.

In order to increase the dynamics and response behavior of the drive train after immediately switching over, the primary drive 1 that is embodied as the internal combustion engine is 'prestressed' in order to be able to react more quickly to the future load demand. For this purpose, a corresponding status is transmitted to an engine control unit of the internal combustion engine. If the status of the energy recovery procedure changes to the restriction operation, then the rotational speed and the boost pressure of the internal combustion engine are adjusted (for example increased) in preparation.

The disclosure discloses a hydrostatic drive having at least one hydrostatic pump 2 for supplying at least one hydrostatic consumer 4 and said hydrostatic drive having an apparatus for the energy recovery procedure of at least a part of the energy that is output by the consumer. The apparatus comprises an electronic control unit 14 or at least a software component with which the energy recovery procedure can be controlled in a variable manner and in this case depends upon at least one detected influencing variable. For this purpose, the apparatus furthermore comprises at least one sensor 16, a camera or an operating element that detects the influencing variable.

LIST OF REFERENCE NUMERALS

1 Primary drive
2 Pump

4 Consumer
6 Further pump(s)
8 Tank
10 Valve block
12 Temperature sensor
14 Control unit
16 Sensor arrangement

The invention claimed is:

1. A hydrostatic drive comprising:

at least one hydrostatic pump configured to supply at least one hydrostatic consumer with operating fluid;

an electric motor configured to drive the hydrostatic drive;

an electronic storage device operably connected to the electric motor;

a temperature sensor configured to determine a sensed temperature of the operating fluid; and an apparatus configured to recover at least a part of a braking energy or decelerating energy generated by the at least one hydrostatic consumer according to an energy recovery procedure, the apparatus including an electronic control unit configured to control the apparatus in a variable manner and in dependence upon at least one detected influencing variable, the electronic control unit operably connected to the temperature sensor, wherein the at least one detected influencing variable includes the sensed temperature, wherein the energy recovery procedure includes selectively storing the braking energy or the decelerating energy in the electronic storage device when the at least one hydrostatic pump is operated as a motor and when the electric motor is operated as a generator, and wherein the electronic control unit is configured to switch off the energy recovery procedure until the sensed temperature is greater than or equal to an optimal operating temperature of the operating fluid, such that a cold start behavior of the hydrostatic drive is optimized.

2. The hydrostatic drive according to claim 1, further comprising:

at least one pressure sensor, wherein the at least one detected influencing variable includes a pressure of the operating fluid or pressures of operating fluids at one or more sites in a drive train of the hydrostatic drive.

3. The hydrostatic drive according to claim 1, wherein the at least one hydrostatic consumer includes a traction motor configured as a pump to generate the braking energy or the decelerating energy.

4. The hydrostatic drive according to claim 1, wherein:

the at least one hydrostatic consumer includes work equipment, and the recovered braking energy is generated from mass inertia or from potential energy.

5. The hydrostatic drive according to claim 1, wherein:

a first hydrostatic consumer of the least one hydrostatic consumer is configured to generate the braking energy or the decelerating energy, and a second hydrostatic consumer of the at least one hydrostatic consumer is supplied directly with the recovered braking energy or decelerating energy.

* * * * *